US005336580A

United States Patent [19]

Tavernier et al.

[11] Patent Number: 5,336,580

[45] Date of Patent: Aug. 9, 1994

[54] CARRIER COMPOSITION FOR ELECTROPHOTOGRAPHY

[75] Inventors: Serge Tavernier, Lint; Werner Op de Beeck, Keerbergen; Danny Van Wunsel, Nijlen; Paul Märksch, Antwerpen, all of Belgium

[73] Assignee: AGFA-Gevaert, N.V., Mortsel, Belgium

[21] Appl. No.: 14,533

[22] Filed: Feb. 8, 1993

[30] Foreign Application Priority Data

Feb. 29, 1992 [EP] European Pat. Off. ..... 92200591.3

[51] Int. Cl.[5] ..... G03G 9/107

[52] U.S. Cl. ..... 430/106.6; 430/108; 430/111; 430/122

[58] Field of Search ..... 430/106.6, 108, 111, 430/122

[56] References Cited

U.S. PATENT DOCUMENTS

| | | | |
|---|---|---|---|
| 4,822,709 | 4/1989 | Ohtani et al. | 430/108 X |
| 4,847,176 | 7/1989 | Sano et al. | 430/108 X |
| 4,879,198 | 11/1989 | Tavernier et al. | 430/108 X |
| 4,902,597 | 2/1990 | Takeda et al. | 430/108 X |
| 5,013,626 | 5/1991 | Matsumura et al. | 430/108 X |

*Primary Examiner*—Roland Martin

*Attorney, Agent, or Firm*—Breiner & Breiner

[57] ABSTRACT

According to the present invention magnetic carrier particles are provided for use in magnetic brush toner-carrier development of electrostatic charge patterns, said particles incorporating finely divided magnetic pigment particles dispersed in a resin binder, characterized in that said carrier particles comprise a mixture of magnetic pigment particles wherein a portion (A) of said pigment particles has a coercive force of more than 300 Oe and another portion (B) of said pigment particles has a coercive force of less than 300 Oe, the weight ratio of said portions (A) and (B) being in the range of 0.1 to 10.

10 Claims, No Drawings

CARRIER COMPOSITION FOR ELECTROPHOTOGRAPHY

DESCRIPTION

1.Field of the Invention

The present invention relates to improvements in electrostatographic developing systems, structures and/or procedures, and embodies the use of an improved type of developing agent, which in combination with a specific type of developing unit and procedure leads to an appreciable improvement in the quality of images created from an electrostatic latent image. The new type of developer offers a flexible design, and improved ease and accuracy in production, leading to reduced costs.

The invention relates to the specific design of the developer, being essentially a developer containing at least two components, one of them being ordinarily referred to as carrier particle, the other being referred to as toner particle. The type of developer being referred to is commonly called the 2-component type developer. The invention is more specifically concerned with the specific design of the carrier particle.

2. Background of the Invention

It is well known in the art of electrographic and electrophotographic copying and printing to form an electrostatic latent image corresponding to either the original to be copied, or corresponding to digitized data describing an electronically available image, on a photoconductive member. In another image forming method, the electrostatic latent image is formed by image-wise discharge over styli towards a dielectric substrate. The xeroprinting process such as disclosed e.g. in European Patent Application 0 243 934 involves image-wise exposing a photopolymer master, charging on a conductive support, toning with dry or liquid toner and transferring to another substrate.

Whereas in certain applications the information building up the latent electrostatic image is presented in a binary way, i.e. presenting the image as a combination of white and black areas, other types of latent images are also gaining interest, more specifically those being composed by a scala of gray levels ranging from zero to full density. In the latter images both spatial and gray level information essentially contribute to the latent image.

Electrostatic latent images can be developed using a liquid developer consisting of a colloidal system of charged colloidal particles in an insulating liquid. In most cases the latent image is developed with a finely divided developing material or toner to form a powder image which is then transferred onto a support sheet such as paper. The support sheet bearing the toner powder image is subsequently passed through a fusing apparatus and is thereafter discharged out of the copying resp. printing machine as a final copy, resp. final print.

As is apparent from the above brief description of the overall electrostatographic process two essential stages should be considered. First a latent electrostatographic image is formed on a suitable member, e.g. a photoconductive drum, secondly this latent image is developed to form a visually discernible image and transferred in a transfer station to a final hard copy.

One of the objectives set forth for the overall electrostatographic process is to provide an image on the final copy, resp. final print with the best possible quality.

By "quality" in electrostatography is generally understood a true, faithful reproduction of the original to be copied, or faithful visual print of the electronically available image.

Quality consequently comprises features such as uniform darkness of the image areas, background quality, clear delineation of lines, as well as overall resolution of the image.

In the case of latent images comprising a whole range of electrostatic levels within the different pixels, a faithful reproduction of these levels into visual gray levels is essential. It is moreover essential that step-like transitions in the latent image can be reproduced in a similar way, without smoothing, enhancing or altering the edge and/or transition zones within the image. An ideal proportionality of the toned image with respect to the latent electrostatic image is therefor essential, and this over a wide range of spatial frequencies.

In an optical electronic printing apparatus, the "quality" and more in particular the resolution of the latent electrostatographic image is determined by the accuracy of each of the following steps: first the conversion of the digitized data describing the electronically available image to an appropriate illumination pattern, secondly the illumination of the photoconductive drum by the laser or light emitting diode system; thirdly the resolution power and gradation characteristics of the photoconductive substrate present on the photoconductive drum. In the case of a xeroprinting device the quality of the latent electrostatic images is determined by the contact exposure step, whereas the "original" can be either line work or half-toned images or screened images or combinations thereof.

In a copying apparatus the "quality" of the latent electrostatographic image is predominantly determined by the accuracy of illumination of the photoconductive drum by the electro-optical system, wherein the optical quality of the mirrors, lenses, optical fibres, etc. used, as well as the solidity, sturdiness and lack of vibrations of the construction play a vital role.

When care is taken to realise a high quality latent electrostatic image, further process steps play an important role in realising the final print-quality: the development step and the transfer step. Praxis learns that the former, i.e. development step is essentially quality determining.

It has been pointed out in WO 91/00548 that with respect to resolution the principal contributing factors are size and size distribution of the developing particles used, and in case a 2-component developer material is used, in particular the size and size distribution of the toner and specific powder characteristics of the toner material.

When the nature of the latent electrostatic image aside from pure line work or screened images, comprises in addition different electrostatic charge levels within the different pixels, hereinafter referred to as gray levels, it is not only necessary to use a developer with high resolving power, but it is also important to realise proportionality of the developed powder image with respect to said gray levels. Moreover transition from different gray levels (e.g. white to gray; gray to black, . . . ) should be reproduced in a "sharp" way, i.e. without smoothing out, edge enhancing and other effects.

Whereas the developer and developing procedure described in said W091/00548 result in a high resolving power, it still contains the generally observed disadvantage of enhancing edge-effects. This phenomenon is noted most clearly in soft gray level areas, which are surrounded by a gray level of large image density difference. When the soft gray area is surrounded by white, it presents a somewhat denser leading edge and a broken-out trailing edge, where the trailing part of the gray area is not filled in in a proper way. This phenomenon arises from the fact that a two component magnetic brush development is used, whereby the magnetic brush runs concurrently with the photoconductor but at higher speed. Consequently magnetic brush portions first come in contact with a "white zone" embodying a negative development potential, commonly called cleaning potential, which makes toner drift away from the photoconductor, as is desired. However some fraction of time later the gray levels impose a positive development potential. The toner drifts towards the photoconductor but during a certain interval of time, corresponding to a certain area in the trailing region of the gray area, noticable lower toner concentration is present on the tip of the magnetic brush, as a consequence of the previous depletion period, and induces a lack of density in the trailing position of the gray area.

The other effect, such as a black leading edge arises from a similar complementary process, whereby the cleaning potential cannot cut the development current immediately; side edge arise from field enhancement.

From the above discussion it becomes apparent that good proportionality, especially in the edge areas is difficult to realise in particular when the conventional magnetic brush development process, characterised by static magnetic poles and movement of the sleeve, is used. In this case the magnetic brush passes over the photoconductor surface in a nearly laminar way, so that it is very sensitive to the phenomena described above, such as depletion etc.

A second disadvantage of the cited developing procedure is the limited toner particles delivery rate. Since the flow of the developer is laminar, only toner particles present on the top-section of the magnetic brush chains can participate in the development process. Hence to realise an appreciable print density, special actions are necessary, each having their particular limitations, such as a high toner concentration, resulting in a high carrier surface coverage, and/or the use of high speed of magnetic sleeve transport versus process speed, resulting in a sufficient delivery. The first action results in limited lifetime of developer and background problems due to poorly charged toner particles. The second action cannot be applied without limitation, as very high linear speeds arise, resulting in degradation of developer and high mechanical impact on the developed image, resulting in image quality degradation.

It is therefore clear that the use of the cited development process is limited to medium speed applications. When extended high density areas are to be developed the problem even is more pronounced.

When using smaller toner particles, as those described in the cited W1091/00548, these phenomena are even more noticeable, due to the fact that, in order to realize a certain density, proportionally more effort has to be made, due to the high charge pro mass ratio of the smaller toner particles. Also the amount of toner to be laid, to realize full density is, proportionally higher, inducing even further problems of the kind cited above.

The above phenomena however also can be observed with larger toner size, when using the magnetic brush development with a two-component developer, and using the stationary magnets mode.

Different solutions to these problems are mentioned in the literature.

In some applications the use of an additional electrical alternating field (AC-field) is discussed as an important improvement of the magnetic brush development method with stationary core and rotating sleeve so as to avoid the above cited problems. The action of the AC-field is to induce some mixing in the laminar brush flow and reducing transition effects and to enhance toner delivery. The AC-field however also induces oscillatory behaviour of the brush influencing resolving power.

Another solution is to use the magnetic brush development with rotating core and rotating or stationary sleeve. A clear description of typical development units of both type, the stationary core rotating sleeve type and the rotating core, rotating or stationary sleeve type can be found in the Hitachi Metals publication, Hitachi components for electrophotographic printing systems, p.5–p.11, published by Hitachi Metals, International Ltd., 2400 Westchester Avenue, Purchase, N.Y., 10577, USA. The rotating core type developing unit is commonly used for monocomponent developers. Its use for dual component systems has also been described, in some patent applications of Minolta Corp., e.g. U.S. Pat. No. 4,600,675, U.S. Pat. No. 4,331,757, U.S. Pat. No. 4,284,702. Similarly the use of said developing process is described in the publication by Matsushita Electronic Components Co. Ltd. on the Pana Fine Process (National Technical Report, Vol. 28, No. 4, Aug. 1982, p. 676). In said publication the positive effects of the rotating core development with dual component developer on fringe effects is cited.

In the cited patents, the dual component developer is based on a composite carrier particle combined with toner particles. The composite carrier is prepared by combining magnetic pigments of the soft ferrite type with a binder resin. The carrier particles exhibit a small amount of remanent behaviour, characterised in coercivity values ranging from about 50 up to 250 Oe depending on the exact nature of pigments used. From the data presented in the cited documents it becomes apparent that a major limitation arises from carrier loss from the brush towards the photoconductor for carrier diameters beneath 50 $\mu$m, in this way imposing a limitation on the softness of the brush as only larger particles can be used. In order to use economically achievable products, only broader size cuts can be used, increasing the average carrier particle size even further.

In their patents U.S. Pat. Nos. 4,473,029, 4,602,863, 4,764,445, and 4,546,060 and in the publication entitled: Designing materials for the Kodak Coloredge Copier Program by E. T. Miskinis, E. Kodak Company, Rochester, N.Y., a similar development process is described, characterised by a further improvement. The aim as described is to realise an efficient toner delivery system enabling high speed developing processes.

From these documents it results that a similar improvement with respect to edge effects is described as discussed in the documents cited supra. The improvement which is put forward resides in the use of magnetically hard carrier particles with a minimum of magnetisation in the magnetic field strength present above a pole position in the developing unit. A coercivity of at least 500 Oe, most preferably 1000 Oe, when magnetically saturated, is desirable, the magnetisation being at least preferably 20 emu/g of carrier material. The size of the carrier definitely is smaller than 50 μm necessary to avoid carrier loss, and situates itself in the 5–45 μm average size range. High performance is reported. The hard magnetic properties are necessary to resist to internally magnetic re-alignment as the moving poles of the core passes beneath the carrier particle. Accordingly the particle is forced to flip for inducing the desired transport, and mixing of the magnetic brush.

Transport cannot be realised with soft magnetic material. A typical magnetic hysteresis curve is shown in the Kodak publication cited supra p. 105 showing indeed a material with a coercivity of 200–300 Oe. The transport increases strongly at higher coercivity. Apart from coercivity the induced moment is also important. A certain amount is put in the product by magnetisation prior to use. The magnetic moment stimulates the transport, and also reduces carrier loss.

Extremely poor flow characteristics of the developer, not present on the magnetic brush, are due to a cohesive nature stemming from the remanence of the materials. A rather strong remanence is present as already an appreciable induced magnetic moment is to be obtained at relatively low magnetic fields, 1000 Oe.

So, it is difficult to create accurately an intermediate situation with respect to remanence and induced moment at 1000 Oe by premagnetisation to a value lower than that obtained at full saturation magnetisation. The total mass of carrier should very accurately receive the same magnetic treatment in a reproducible way.

Hard magnetic pigments have a limited magnetization value, which ideally have approximately an induced moment of 30 emu/g at 1000 Oe. When realising a composite material therewith a dilution occurs as a volume loading of more than 50% is difficult to achieve. It hence results in an induced moment of the particle of at most 25 emu/g which comes rather close to the lower value for carrier loss.

Therefore, with this concept, it is only possible to realise good performing carriers within certain limits.

In JP-A 60 196 777 (see also Patent Abstracts of Japan vol 10, no 53 (p 433) (2110) Mar. 4, 1986) a carrier for use in electrostatic charge developers is described, wherein the carrier bulk is composed of a mixture of large carrier particles (about 100 to 500 μm) consisting of a material having $\geqq 10^{13}\Omega$.cm resistance and high coercive force of $\geqq$2000 Oe and small carrier particles (about 10 to 100 μm) consisting of an ordinary type of magnetic material having $\leqq 10^{9}\Omega$.cm resistance and a coercive force of $\leqq$500 Oe. Carrier particles having an average particle size between 100 and 500 μm impose a limitation on the softness of the brush. When using carrier particles with that high average particle size it is impossible to make low weight carriers (perfectly embodied when using composite carrier materials), which is required in high speed copying systems.

OBJECT OF THE INVENTION

It is an object of the present invention to realise a carrier material offering high image quality in particular when used in a rotating core magnetic brush development process.

It is a further object of the invention to provide a carrier that combines the properties of a soft magnetic carrier with the properties of a hard magnetic carrier within the same carrier particle.

A further object of the present invention is to provide a developer characterised by a high flowability. Other advantages will become apparent from the detailed description.

SUMMARY OF THE INVENTION

In accordance to the present invention magnetic carrier particles are provided suited for use in magnetic brush toner-carrier development of electrostatic charge patterns, said carrier particles incorporating finely divided magnetic pigment particles dispersed in a resin binder, characterized in that said carrier particles comprise a mixture of magnetic pigment particles wherein a portion (A) of said pigment particles has a coercive force of more than 300 Oe and an other portion (B) of said magnetic pigment particles has a coercive force of less than 300 Oe, the weight ratio of said portions (A) and (B) being in the range of 0.1 to 10.

According to a preferred embodiment, said carrier particles contain in admixture magnetic pigment particles (A) having a coercive force of at least 500 Oe, preferably at least 1000 Oe, more preferably at least 3000 Oe, and magnetic pigment particles (B) having a coercive force of less than 300 Oe.

DETAILED DESCRIPTION OF THE INVENTION

The carrier material described supra is in fact a composite carrier containing both "soft" and "hard" magnetic pigments. A clear description of magnetic materials, classification behaviour etc. is presented in numerous publications as for example Uhlmann 5th edition, Vol. A-16, p. 1 e.a.

Magnetic pigments

As soft magnetic pigments a variety of materials can be used, which comprise magnetic metal pigments such as fine powder, Fe powder, other metals and/or alloys, as well as magnetic oxide pigments both pure ironbased, such as magnetite, mixed iron oxide, etc. and mixed oxide magnetic pigments, commonly referred to as ferrite of the soft type which can be represented by the general formula:

$$M\frac{1-x}{1+x}(1-y)\mathrm{Fe}\frac{2x}{1+x}(1-y)Oy$$

wherein M denotes at least one atom selected from the group consisting of divalent, monovalent or trivalent ions such as Mn, Mi, Co, Mg, Ca, Zn and Cd, furtheron doped with monovalent or trivalent ions. The pigments referred to as soft are characterized by a coercivity of at most 300 Oe, as found by applying the procedure described below.

The coercivity of a magnetic material is the minimum external magnetic force necessary to reduce the remanence Br to zero while it is held stationary in the external field, and after the material has been magnetically saturated, i.e. the material has been permanently magnetized. A variety of apparatus and methods for the measurement of the coercivity of the carrier particles according to our invention can be employed. For the present invention, a Princeton Applied Research Model 155 Vibrating Sample Magnetometer, available from Princeton Applied Research Co., Princeton, N.J., is used to measure the coercivity of powder particle samples. The powder was mixed with a nonmagnetic polymer powder (90 percent magnetic powder: 10 percent polymer by weight). The mixture was placed in a capillary tube, heated above the melting point of the polymer, and then allowed to cool to room temperature. The filled capillary tube was then placed in the sample holder of the magnetometer and a magnetic hysteresis loop of induced magnetism (in emu/gm) versus external field (in Oersted units) was plotted. During this measurement, the sample was exposed to an external field of 0 to 8000 Oersted.

When a powdered material is magnetically saturated and immobilized in an applied magnetic field H of progressively increasing strength, a maximum, or saturated magnetic moment, Bsat, will be induced in the material. If the applied field H is further increased, the moment induced in the material will not increase any further. When the applied field, on the other hand, is progressively decreased through zero, reversed in applied polarity and thereafter increased again, the induced moment B of the powder will ultimately become zero and thus be on the threshold of polarity reversal in induced moment. The value of the applied field H necessary to bring about the decrease of the remanence, Br, to zero is called the coercivity Hc of the material. The described soft magnetic pigments of the present invention exhibit a coercivity of less than 300 Oersted when magnetically saturated, preferably a coercivity of at most 200 Oersted and most preferably a coercivity of at most 100 Oersted. The hard magnetic pigments then show a coercivity of at least 300 Oe, preferably at least 1000 Oe, and more preferably at least 3000 Oe. In this regard, while magnetic materials having coercivity levels of 3000 and 6000 Oersted have been found useful; there appears to be no theoretical reason why higher coercivity levels would not be useful.

In addition to the coercivity requirements of the magnetic material, the carrier particles of this invention exhibit an induced magnetic moment B of at least 20 emu/gm, based on the weight of the carrier, when present in a field of 1000 oersted, after full magnetisation.

Useful hard magnetic materials include hard ferrites and gamma ferric oxide. The hard ferrite are represented by a similar composition as cited above, whereby specific ions such as Be, Pb, or Sr are used as disclosed in U.S. Pat. No. 3,716,630.

In general both magnetic pigment types (A) and (B) can have any shape, but should have a size at most half of the size of the final carrier, preferably one tenth. Moreover sferoidal, cubic like amorphous shape is preferred as better realisation of the final binder/pigment compound can be realised. Needle shaped pigments indeed may show damage due to shear forces during the mixing process. Both magnetic pigment types (A) and (B) used in the present invention may have a different average particle size as described in EP-A-0 289 663 as to further enhance the homogeneity of the carrier particles.

Binder material

Apart from said magnetic pigment particles the carrier particles according to the present invention comprise a binder resin.

The binder resin used with the magnetic pigment is selected to provide the required mechanical and electrical properties. It should (1) adhere well to the magnetic pigment, (2) facilitate formation of strong, smooth-surfaced particles and (3) preferably possess sufficient difference in triboelectric properties from the toner particles with which it will be used to insure the proper polarity and magnitude of electrostatic charge between the toner and carrier when the two are mixed.

The binder resin can be organic, or inorganic, such as a binder composed of glass, metal, silicone resin or the like. Preferably, an organic material is used such as a natural or synthetic polymeric resin or a mixture of such resins having appropriate mechanical properties. Appropriate monomers (which can be used to prepare resins for this use) include, for example, vinyl monomers such as alkyl acrylates and methacrylates, styrene and substituted styrene, basic monomers such as vinyl pyridines, etc. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of composite carrier particles according to this invention may involve the application of heat to soften thermoplastic material or to harden thermosetting material; evaporative drying to remove liquid vehicle; the use of pressure, or of heat and pressure, in molding, casting. extruding, etc., and in cutting or shearing to shape the carrier particles; grinding, e.g., in a ball mill to reduce carrier material to appropriate particle size; and sifting operations to classify the particles.

According to one preparation technique, the powdered magnetic material is dispersed in a dope or solution of the binder resin. The solvent may then be evaporated and the resulting solid mass subdivided by grinding and screening to produce carrier particles of appropriate size.

According to another technique, emulsion or suspension polymerization is used to produce uniform carrier particles of excellent smoothness and useful life.

In general the use of an organic binding material and use of the thermoplastification and melt-homogenisation of the binder and pigments are preferred. To enhance the mechanical stability of the composite carrier, a binder resin with some hydrophilic components is preferred.

The binder resin containing hydrophilic functional groups is e.g. of the type described in U.S. Pat. No. 4,600,675, wherein the hydrophilic groups are preferably at least partly carboxylic acid groups present in an amount sufficient to provide resins with an acid value, also called acid number, in the range of 5 to 250 mg/g.

Preferred resins are copolymers of styrene with unsaturated acids such as acrylic acid and methacrylic acid and alkyl esters thereof. Further polyester resins such as those produced by condensation reaction of a polyol or mixture of polyols, e.g. ethylene glycol, triethylene glycol and an alkoxylated bisphenol, especially bisphenol A, i.e. [2,2-bis(4-hydroxyphenyl)-propane], with a dicarboxylic acid or mixture of dicarboxylic acids, e.g. maleic acid, fumaric acid, itaconic acid, malonic acid, isophthalic acid and partly of a polyacid having at least 3 carboxylic acid groups such as trimellitic acid yielding some crosslinking are suitable binder resins for the purpose of the present invention.

The preparation of linear polyester resins of the above type is described in GB Pat. No. 1,373,220.

A particularly useful polyester binder is derived from fumaric acid that is polycondensed with an ethoxylated "bisphenol A", i.e. ethoxylated 2,2-bis(4-hydroxyphenyl)propane.

In order to obtain carrier compositions having high resistance to abrasion polyester resins containing some degree of crosslinking are preferred.

The synthesis of such resins is described e.g. in published GB-2082788A patent application disclosing toner comprising as a binder a polyester resin obtained from a diol or mixture of diols represented by the following general formula:

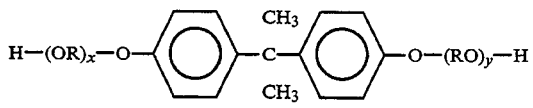

wherein R represents an ethylene or propylene group, x and y are independent numbers such that the average value of their sum is 2 to 7; and a polycarboxylic acid or a derivative thereof, which is a mixture of a dicarboxylic acid or a $C_{1-6}$ alkyl ester thereof and a tri- or polycarboxylic acid or an acid anhydride thereof, the content of said tri-or polycarboxylic acid or acid anhydride being from 30 to 80 mol % of the acids.

It has been established experimentally also that the resistance to abrasion can likewise be improved by combining the above polyester resins with copolymers of styrene and allyl alcohol. The presence of the free hydroxyl group of the allyl alcohol units provides a good wetting power for hydratable metal oxides.

The preparation of allyl alcohol -styrene copolymers is described by hildknecht in "Allyl Compounds and their Polymers" Vol. 28, p; 204–206 (1973), John Wiley & Sons, Interscience Publishers, U.S.A.

Particularly suitable styrene allyl alcohol copolymers have a hydroxyl content of 5.4 to 6% by weight and a molecular weight in the range of 1,500 to 2,400 and are sold under tile trade names RJ 100 and RJ 101 of Monsanto U.S.A. The styrene allyl alcohol copolymers are preferably used in amount of 10 to 20% by weight with respect to the total binder content of the carrier particles.

Preparation of carrier

The magnetic carrier particles according to the present invention can be produced by dispersing the magnetic powders in the resin binder melt, allowing the molten dispersion to solidify and crushing and milling the obtained solid. By wind sifting or sieving particles sizing in the range of 35 to 150 μm are separated.

According to a particular embodiment the magnetic powders are incorporated in the binder in combination with carbon black controlling in that way the specific resistivity of the carrier particles. A suitable amount of carbon black is in the range of 0.2 to 5% by weight with respect to the magnetic powders.

In order to obtain carrier particles with good flowing properties flow enhancing agents can be melt-mixed within the carrier composition yielding a carrier particle surface provided with small spacer particles, that are optionally embedded therein after the milling process. Suitable flow improving agents are e.g. colloidal silica and $Al_2O_3$-particles of submicron particle size. Another way to improve the flowing properties is by producing carrier particles having a spherical or spheroidal shape.

Such can proceed by spraying a melt or according to a heating-dispersion technique described in U.S. Pat. No. 4,345.015. According to the latter technique carrier particles obtained by crushing are dispersed in a carrier liquid in which the resin binder does not dissolve in the presence of colloidal hydrophobic silica in a concentration to inhibit coagulation of the particulate material when heat-softening the resin binder; the dispersion is heated with stirring to a temperature at which the resin of the particles softens but does not melt and the particles acquire a spherical or spheroidal shape and the dispersion is then cooled down to a temperature at which the resin binder of the particles is no longer sticky, and finally the carrier particles are separated, e.g. by filtering or centrifuging and dried. The amount of hydrophobic colloidal silica generally ranges from 0.2 to 2.0 parts by weight per 100 parts by weight of carrier particles and has no detrimental influence on triboelectric properties, and further promotes flowing properties as explained above by being partially embedded in the carrier surface.

Toner

The toner for use in combination with carrier particles of the present invention can be selected from a wide variety of materials, including both natural and synthetic resins and charge controlling agents as disclosed e.g. in U.S. Pat. Nos. 4,076,857 and 4,546,060. The carrier particles of the present invention may be used in combination with a starter and replenisher toner of different average grain size as described e.g. in published EP-A 0248119.

The shape of the toner particles can be irregular, as is the case in ground toners, or spheroidal. Spheroidization may proceed by spray-drying or the heat-dispersion process disclosed in U.S. Pat. No. 4,345,015.

In WO 91/00548 the use of a fine toner exhibiting specific particle size characteristics and flowing characteristics is described, which toner can be combined with the carrier particle of the present invention.

Toner-carrier mixture

Whereas the tribo-electrical modeling between carrier and toner can be done by changing the toner formulation and/or the coating of carrier by different processes such as fluidized bed spray drying, chemical vapour deposition methods, etc. the addition of charge controlling agents to the carrier composition during the preparation is an obvious method, which arises from the typical design of the carrier itself.

The developers as described above can be used as such, although, it is preferred to premagnetise the carrier or developer to a certain degree, in order to realise a permanent magnetic dipole moment within each carrier bead, which will afterwards react on the alternating magnetic field obtained by having the magnetic core of the developing unit rotate. It is preferred from the production way however to magnetize in saturation.

To realize a certain set of magnetic properties it could be envisaged to magnetise not in saturation; a procedure which is more critical in production as not each particle possibly receives the same treatment. A better method is to use the benefit of the flexible design, in ratio of hard and soft pigment, and the concentration, to induce the appropriate magnetic behaviour by the full magnetization.

The developer will be preferentially used in combination with a rotating magnetic core developing device for magnetic brush development.

More specifically the magnetic development unit used in our experiments consists of a multipolar magnetic core, showing 12 poles, having each 680 Gauss top field on a pole position, with sinusoidal field. The diameter is 29.3 mm. A sleeve, diameter 31.4 mm in aluminium material is positioned concentrically. A blading knive is positioned at a clearing distance of 0.5 mm. The magnetic development unit is positioned opposite to a photoconductor with a clearance of 600 μm. The speed of rotation for the core was 1500 rpm countercurrently, for the shell 80 rpm concurrently with the photoconductor running at 10 cm/sec.

It should be explained that these are typical values, not limiting in any way the present invention to such arrangement in general.

In order to analyze the development efficiency and carrier loss a DC-voltage was applied on the developing unit. The photoconductor base plate was set at ground potential, the photoconductor having no net charge. The DC voltage ranged from −300 Volt, causing development since a negative toner polarity was used, up to +400 Volt, causing carrier loss by carrier by development. The amount deposited on the photoconductor was measured as a fingerprint of material and process.

As the flowability is an important aspect of the developer the flow of magnetised material was measured. Use was made of the flow measuring device "Flodex" consisting essentially of a loading cylinder with a diameter of 5.7 cm and length of 10 cm, which was fitted at the bottom with a plate, with central hole with a predeterminated diameter, and stopped with a rubber stopper. After loading with 100 g of carrier material the stopper was removed, and it was checked whether the carrier flew out or not. By repeating the experiment with different holes, the smallest hole was noted at which flow still occured. The smaller the hole at which flow still occurred, the higher the flowability of the particles being measured.

As a last criterium transport in the developing unit was also observed. Image quality was controlled by developing a real image, containing as well lines, black areas, screened-and gray level-images, and transition zones.

EXAMPLES

The examples described hereinafter illustrate the present invention. All ratios and percentages are by weight unless otherwise indicated.

EXAMPLE 1

A mixture containing:

(1) 19 parts of a partially crosslinked polyester of propoxylated bisphenol A polycondensed with a mixture of isophthalic acid and benzene-1,2,4-tricarboxylic acid characterized by a softening point of 132° C. (ring and ball method), glass transition temperature of 64° C., and acid value 18 mg KOH/g, (2) 33 parts of a hard magnetic pigment having a Ba-containing ferrite structure with coercitive force of 3705 Oe, when magnetized, remanence of 31 emu/g and a saturation magnetisation of 61 emu/g, particle size around 0.2 μm, (3) 48 parts of a soft magnetic pigment having a magnetite structure with coercitive force of 130 Oe, when magnetised, remanence of 7 emu/g, saturation magnetisation of 78 emu/g, particle size around 0.5 μm, was melt-kneaded for 30 min at 185° C. After cooling the kneaded mass was pulverized in an impact mill and powder particles sized between 25 μm and 50 μm were separated by appropriate sieving procedures.

The obtained particles were magnetically characterized after melting to a solid mass after magnetisation. A coercivity of 275 Oe was measured, remanence, magnetisation of 18 emu/g, a saturation magnetisation of 72 emu/g and magnetic induction at 1000 Oe of 60 emu/g.

The carrier was magnetised up to saturation. A developer was realised by admixing a fine polyester-based toner with particle size 4.7 μm (average by volume) determined by Coulter Counter.

The developer contained 14% toner expressed to carrier in weight by weight. The toner charge was −18 μc/g as determined by blow-off methods.

The developer was loaded in the developing unit described above and good transport was observed under the cited experimental conditions. The amount of carrier on the development roller was 28.5 mg/sq.cm. The development characteristics were excellent yielding at said development gap of 0.6 mm on a photoconductor of the organic type (16 μm thickness) and at a process speed of 10 cm/sec a developed transmission toner density of 0.75 at −100 V bias and of 1.45 at −200 bias voltage. Carrier loss occured at +275 V bias potential or higher. This implies a broad operating window to obtain excellent background free images. The resolution was excellent as well as the homogenity and the transition edges.

The flowability of the developer was determined by the above described method and yielded a flowability of 22.

EXAMPLE 2

Example 1 was repeated with the exception that the soft magnetic pigment was replaced by a soft ferrite material having an average particle size of 1–2 μm, and coercivity of 15 Oe when magnetically saturated, a remanence of 2 emu/gm and saturation magnetisation of 75 emu/g and having a chemical composition of $Mn_xFe_yO_Z$. The binder resin was used for 12 parts, the described soft pigment for 52 parts, the hard pigment for 36 parts. After preparation the carrier showed a coercivity of 150 oersted after saturation magnetisation, a remanence of 12 emu/g, a saturation magnetisation of 75 emu/g, and a magnetic induction at 1000 Oe of 50 emu/g.

The carrier was magnetized up to saturation and combined with a toner composition identical to example 1, except that the average particle size was 5.92 μm, and the developer was containing 8% of toner particles with respect to carrier particles w/w. The charge was −18 μC/g; transport was observed with a high magnetic brush loading of 43.3 mg/sq.cm. The carrier loss starts up from +365 V bias potential. The toner density realised at −100 V developing potential was 0.64, at −200 V it was 1.24. Good image quality was observed. The flowability measured as described above corresponded to 22.

EXAMPLE 3 (comparative)

Example 2 was repeated except that to 12 parts of the binder resin, 88 parts of the soft pigment was added and no hard pigment. After the preparation of the carrier the magnetic properties were measured and yielded a coercivity of 15 Oe after magnetisation up to saturation, a remanence of 2 emu/g and saturation magnetisation of 70 emu/g and a magnetic induction of 50 emu/g at 1000 Oe. A developer similar to that described in example 2 was realised. The flowability of the developer was high and corresponded to 15. However bad transport was observed in the developing unit, and uneveness in developing characteristics. From this comparative example it becomes apparant that a certain permanent magnetic dipole (remanence) should be present to realise transport, a dipole with sufficient strength to withstand changing magnetic field, and hence induce the carrier bead to transport and tumble on the development roller.

EXAMPLE 4 (comparative)

Example 2 was repeated except that for 20 parts of the binder, 80 parts of the hard pigment was used and no soft pigment. After preparation the carrier was found to have a coercivity of 3700 Oe after full magnetisation, a remanence of 30 emu/g, a saturation magnetisation of 60 emu/g and magnetic induction at 1000 Oe of 35 emu/g. Good transport was found in the developing unit with a brush coverage of 71 mg/sq.cm. Medium developing properties were present with a toning density at −100 V bias of 0.28 and at −200 V developing bias of 0.65 However a more pronounced carrier loss occured, starting at 150 V cleaning potential. This observation shows that towards carrier loss not the remanence, but the induced moment at moderate fields (region 1000 Oe) is important, resulting in this particular case to higher sensitivity for carrier loss (35 emu/g) in comparison to example 1 (60 emu/g). Also a bad flow was observed for the hard composite developer.

From this example it becomes clear that too strong a coercivity and remanence causes bad flow behaviour, inducing on its turn mixing problems, addition of toner problems, transport problems within the developing unit and especially in the cross mix section.

At the same time when the induced moment at 1000 Gauss is low only a limited working range is present to suppress background due to higher sensitivity towards carrier loss.

EXAMPLE 5

Example 1 was repeated except that the soft magnetic component was replaced by a 2 μm size soft ferrite pigment with coercivity of 15 Oe, a remanence of 2 emu/g and saturation magnetisation of 75 emu/g and that the hard magnetic pigment was replaced by a strontium and ferrit pigment with 2 μm size, coercivity of 2480 Oe, remanence of 20 emu/g, saturation magnetisation of 41 emu/g. The composition was 14 parts of binder resin, 29 parts of soft magnetic pigment, 57 parts of hard magnetic pigment. After preparation a coercivity of 600 Oe after full magnetisation was observed, a remanence of 22 emu/g, a saturation magnetisation of 66 emu/g and magnetic induction of 42 emu/g at 1000 Oe. A behaviour similar to that described in example 1 was found. However, a small decrease in flowability was observed corresponding to a figure of 23 measured as described above.

EXAMPLE 6

Example 2 was repeated with 11 parts of binder resin, 44.5 parts of soft magnetic pigment and 44.5 parts of hard magnetic pigment. After preparation a coercivity of 310 Oe after full magnetisation was observed, a remanence of 19 emu/g, magnetic induction of 62 emu/g at 1000 Oe and saturation magnetisation of 84 emu/g. A similar behaviour as described in example 2 was found.

The toner density realised at −100 V developing potential was 0.53 at −200 V it was 0.8. The carrier loss starts up from 275 V bias potential.

The flowability measured as described above corresponded to 22. The toner charge as determined by conventional blow-off methods amounted to −19.8 μC/g.

We claim:

1. Magnetic carrier particles suitable for use in magnetic brush toner-carrier development of electrostatic charge patterns, said carrier particles incorporating finely divided magnetic pigment particles dispersed in a resin binder, characterized in that said carrier particles comprise a mixture of magnetic pigment particles wherein a portion (A) of said pigment particles has a coercive force of more than 300 Oe and another portion (B) of said pigment particles has a coercive force of less than 300 Oe, the weight ratio of said portions (A) and (B) being in the range of 0.1 to 10.

2. Magnetic carrier particles according to claim 1, wherein said particles comprise of a mixture of magnetic pigment particles (A) having a coercive force of at least 1000 Oe and magnetic pigment particles having a coercive force of less than 300 Oe.

3. Magnetic carrier particles according to claim 1, wherein said particles comprise a mixture of magnetic pigment particles (A) having a coercive force of more than 300 Oe and magnetic pigment particles having a coercive force of at most 200 Oe.

4. Magnetic carrier particles according to claim 1 wherein said particles comprise a mixture of magnetic pigment particles (A) having a coercive force of at least 1000 Oe and magnetic pigment particles (B) having a coercive force of at most 200 Oe.

5. Magnetic carrier particles according to claim 1 wherein said carrier particles have an average particle size in the range 15 to 150 micron, an induced moment of at least 20 emu/g in an applied field of 1000 Oersted and a remanence of at least 5 emu/g.

6. Magnetic carrier particles according to claim 1 wherein the magnetic pigment particles have an average particle size in the range of 0.05 to 10 micron.

7. Magnetic carrier particles according to claim 1 wherein the ratio of said magnetic pigment particles to the resin binder is at least 25 percent by volume.

8. Magnetic carrier particles according to claim 1 wherein the weight ratio of portion (A) of said magnetic pigment particles and portion (B) is in the range of 0.25 to 4.

9. Magnetic carrier particles according to claim 1 wherein the weight ratio of portion (A) of said magnetic pigment particles and portion (B) particles is in the range of 0.33 to 3.

10. Method for electrophotographic printing comprising the steps of providing a rotating core and applying a carrier and toner particles to said core in an amount sufficient to build a rotating core magnetic brush wherein said carrier particles comprise a mixture of magnetic pigment particles dispersed in a resin binder wherein a portion (A) of said pigment particles has a coercive force of more than 300 Oe and another portion (B) of said pigment particles has a coercive force of less than 300 Oe, the weight ratio of said portions (A) and (B) being in the range of 0.1 to 10.

* * * * *